US005600335A

United States Patent [19]

Abramo

[11] Patent Number: 5,600,335

[45] Date of Patent: Feb. 4, 1997

[54] HIGH-POWER BROADBAND ANTENNA

[75] Inventor: Robert S. Abramo, San Diego, Calif.

[73] Assignee: The United States of America as represented by the Secretary of the Navy, Washington, D.C.

[21] Appl. No.: 369,594

[22] Filed: Dec. 21, 1994

[51] Int. Cl.[6] ..... H01Q 9/00

[52] U.S. Cl. ..... 343/749; 343/722; 343/858

[58] Field of Search ..... 343/749, 722, 343/751, 752, 850, 856, 857, 858, 859, 865, 853; H01Q 9/00

[56] References Cited

U.S. PATENT DOCUMENTS

| | | | |
|---|---|---|---|
| 3,774,221 | 11/1973 | Francis | 343/749 |
| 3,803,615 | 4/1974 | Goodbody | 343/709 |
| 3,984,839 | 10/1976 | Ray, Jr. | 343/749 |
| 4,545,059 | 10/1985 | Spinks, Jr. et al. | 375/1 |
| 5,111,213 | 5/1992 | Jahoda et al. | 343/722 |
| 5,173,713 | 12/1992 | Yves et al. | 343/749 |
| 5,233,362 | 8/1993 | Villaseca et al. | 343/749 |

OTHER PUBLICATIONS

Abramo, "Broadband, High–Power, 2–30 MHz, Twin–Whip Antenna", NCCOSC RDTE DIV Technical Document 2597, Jan. 1994.

Halpern et al., "A Study of Whip Antennas for Use in Broadband HF Communication Systems", RM Associates, Feb. 1986.

*Primary Examiner*—Hoanganh T. Le
*Attorney, Agent, or Firm*—Harvey Fendelman; Michael A. Kagan; Eric James Whitesell

[57] ABSTRACT

A high-power broadband antenna comprises an impedance matching transformer electrically coupled to a radio frequency source generating an input signal having a base wavelength corresponding to the lowest frequency of the input signal. The impedance transformer is electrically coupled to at least two vertical antenna sections. Each antenna section comprises a plurality of substantially collinear electrically conductive radiating elements fixed to an electrical insulator mounted on a horizontal ground plane. Each radiating element has a length appropriate to effect optimum overall efficiency of the high-power broadband antenna over the frequency bandwidth of the input signal. At least two loading elements are each electrically coupled between the radiating elements in each antenna section. Each loading element comprises a parallel combination of a resistor, an inductor, and a capacitor to effect optimum overall efficiency of the high-power broadband antenna over the frequency bandwidth of the input signal.

7 Claims, 4 Drawing Sheets

Table of dimensions and component values for FIG. 1
12.6-meter twin whip antenna with 2 loads per whip:

| | |
|---|---|
| a | 12.6 m |
| b | 10.7 m |
| c | .3 m |
| d | 3. m |
| e | .152 m |
| f | .6 m |
| g | .625 m |

| | R | L | C |
|---|---|---|---|
| upper load element | 300 Ω | 5 μH | 0-15 pf (parasitic) |
| lower load element | 300 Ω | 10 μH | 300 pf |
| | L | $C_1$ | $C_2$ |
| impedance transformer | 8 μH | 25 pf | 2500 pf |

RF transformer ratio = 1:3

*FIG. 4*

Table of dimensions and component values for FIG. 5
11.6-meter twin whip antenna with 3 loads per whip:

| | |
|---|---|
| a | 11.6 m |
| b | 9.86 m |
| c | .3 m |
| d | 3. m |
| e | .152 m |
| f | .6 m |
| g | .625 m |
| h | 1.74 m |

| | R | L | C |
|---|---|---|---|
| upper load element | 300 Ω | 5 μH | 0-15 pf (parasitic) |
| center & lower load element | 300 Ω | 10 μH | 300 pf |
| | L | $C_1$ | $C_2$ |
| impedance transformer | 7 μH | 25 pf | 2500 pf |

RF transformer ratio = 1:3

*FIG. 6*

HIGH-POWER BROADBAND ANTENNA

STATEMENT OF GOVERNMENT INTEREST

The invention described herein may be manufactured and used by or for the Government of the United States for governmental purposes without the payment of any royalties thereon or therefor.

BACKGROUND OF THE INVENTION

The present invention relates to the field of radio frequency antennas. More particularly, but without limitation thereto, the present invention is directed to a high-power broadband antenna.

The incorporation of RLC (resistor-inductor-capacitor) electrical networks into a whip antenna structure to maintain an acceptably low voltage standing wave ratio (VSWR) with increased frequency bandwidth is well known. A single whip antenna using this technique is described by B. Halpern and R. Mittra, RM Associates, Champaign, Ill. in "A Study of Whip Antennas for Use in Broadband Communications Systems" prepared for Naval Electronics Systems Command, Washington, D.C., February 1986. The antennas in this study were single whip antennas, and did not cover the entire HF band of 2–30 MHz with a VSWR of less than about 3:1. Further research at the Naval Command, Control, and Ocean Surveillance Center in San Diego, Calif. established that a single whip antenna can be made to cover the entire HF band by incorporating two RLC electrical networks having appropriate component values and located between antenna elements having appropriate lengths. This technique is referred to as "electrical loading". A problem with this technique is that at lengths of about 12 meters the radiation efficiency falls below 10 percent under 4 MHz, and below 2 percent under 3 MHz. The average radiation efficiency between 6–30 MHz would only be about 45 percent. With currently available resistors, such an antenna can accept a maximum RF power input of only about 1–2 kW.

A need thus exists to increase the power handling capability of HF antennas in the range of 2–30 MHz, and to improve overall antenna efficiency over the broadband frequency range. The present invention is directed to these needs and may provide further related advantages.

SUMMARY OF THE INVENTION

The presently preferred embodiment described below of a high-power broadband whip antenna is directed to HF band antennas. However, this embodiment of the present invention does not preclude other embodiments and advantages that may exist or become obvious to those skilled in the art.

A high-power broadband antenna comprises an impedance matching transformer electrically coupled to a radio frequency source generating an input signal having a base wavelength corresponding to the lowest frequency of the input signal. The impedance transformer is electrically coupled to at least two vertical antenna sections. Each antenna section comprises a plurality of substantially collinear electrically conductive radiating elements fixed to an electrical insulator mounted on a horizontal ground plane. Each radiating element has a length appropriate to effect optimum overall efficiency of the high-power broadband antenna over the frequency bandwidth of the input signal.

At least two loading elements are each electrically coupled between the radiating elements in each antenna section. Each loading element comprises a parallel combination of a resistor, an inductor, and a capacitor to effect optimum overall efficiency of the high-power broadband antenna over the frequency bandwidth of the input signal.

In an alternative embodiment, each antenna section may be made of a material having an appropriate combination of resistance, inductance, and capacitance to effect optimum overall efficiency of the high-power broadband whip antenna over the frequency bandwidth of the input signal.

An advantage of the present invention is improved radiation efficiency, about 2–5 percent around 2 MHz and 65–70 percent over 6–30 MHz, depending on the particular antenna configuration used. The overall efficiency, which takes antenna mismatch loss and all other system losses into account, is also improved.

Another advantage of the present invention is that no resistive attenuator at the input is required to achieve the optimum VSWR, further improving the overall efficiency.

A further advantage of the present invention is greater power handling capacity due to lower power dissipation in the load resistors of the loading elements.

A further advantage of the present invention is that additional loading elements may be added to increase the power handling capability of the antenna.

The features and advantages summarized above in addition to other aspects of the present invention will become more apparent from the description, presented in conjunction with the following drawings.

BRIEF DESCRIPTION OF THE DRAWINGS

FIG. 4 is a table of dimensions and component values for a twin-loaded 12.6-meter twin whip antenna.

FIG. 6 is a table of dimensions and component values for a triple-loaded 11.6-meter twin whip antenna.

DESCRIPTION OF THE INVENTION

The following description presents the best mode currently contemplated for practicing the present invention. This description is not to be taken in a limiting sense, but is presented solely for the purpose of disclosing how the present invention may be made and used. The scope of the invention should be determined with reference to the claims.

Figure 1:
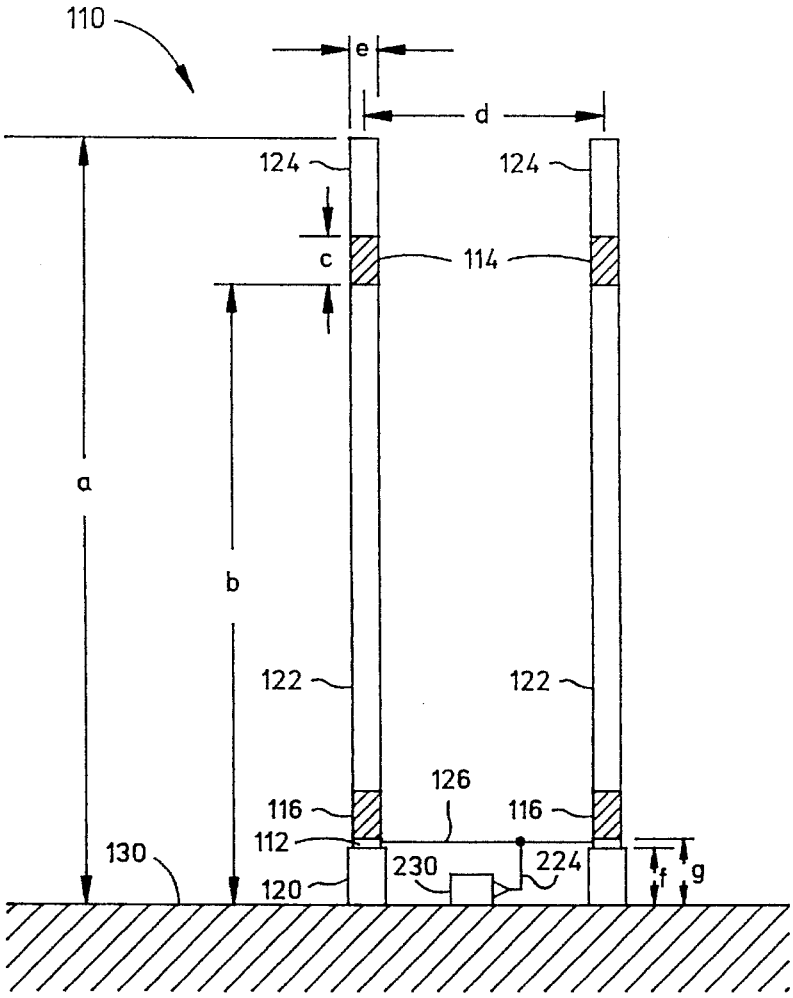
FIG. 1 depicts a structure embodying a twin whip antenna of the present invention.
Figure 2:
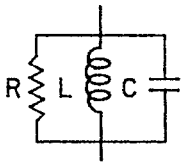
FIG. 2 is an electrical schematic of a loading element of an antenna section.

Referring now to FIG. 1, an example of a structure for a twin whip antenna 110 comprises an impedance matching transformer 230 electrically coupled to lower sections 112. Twin whip antenna 110 has an overall length 'a' about equal to 8 percent of a base wavelength corresponding to the lowest frequency of a feed signal 224. Twin whip antenna 110 may be fixed to electrical insulators 120 having a height appropriate to the voltage breakdown strength of the insulating material and the voltage magnitude of feed signal 224. Electrical insulators 120 are preferably fixed to a horizontal ground plane 130 and spaced apart a distance 'd' of about 2 percent or less of the base wavelength. Lower sections 112 are located between insulators 120 and lower loading elements 116, respectively. Lower loading elements 116 are located between lower sections 112 and center sections 122, respectively. Upper loading elements 114 are located between center sections 122 and upper sections 124, respectively. Upper sections 124 have a length of about 1 percent of the base wavelength. Center sections 122 have a length of about 6 percent of the base wavelength. Lower sections 112 have a length sufficient for making an electrical connection to a feed wire 126. A table of dimensions for a 12.6-meter twin whip antenna is given in FIG. 4 by way of example.

In FIG. 1, upper sections 124, center sections 122, and lower sections 112 are preferably made of an electrically conductive metal, such as aluminum or stainless steel, formed into an appropriate shape, for example, a solid or hollow cylinder, having an outer diameter 'e' or an upward taper.

A feedwire 126 conducts feed signal 224 from impedance matching transformer. 230 to twin whip antenna 110 at lower sections 112. Lower loading elements 116 control antenna response primarily for lower band frequencies. Upper loading elements 114 control antenna response primarily for upper band frequencies. Feed signal 224 radiates from center sections 122 and upper sections 124.

Figure 3:
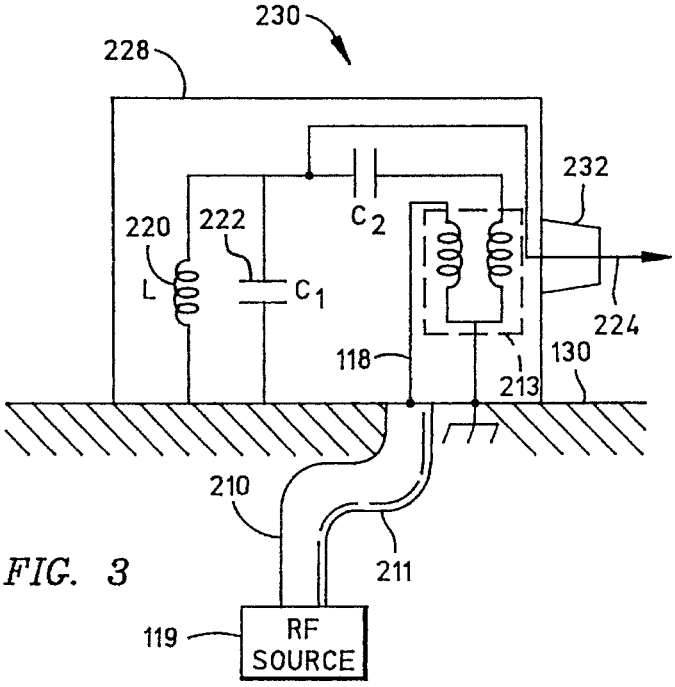
FIG. 3 is an electrical schematic of an impedance matching transformer for coupling the antenna sections to a radio frequency source.

Impedance matching transformer 230 in FIG. 1 is shown in further detail in the electrical schematic of FIG. 3. A coaxial feed cable 210 conducts an input signal 118 from a radio frequency (RF) source 119 to a 1:3 RF transformer 213. Cable shield 211 is electrically coupled to ground plane 130. RF transformer 213 couples input signal 118 to a series capacitor $C_2$. Series capacitor $C_2$ is electrically coupled to an inductor L connected in parallel with a parallel capacitor $C_1$. Inductor L and parallel capacitor $C_1$ are electrically returned to ground plane 130. Feed signal 224 is tapped between series capacitor $C_2$ and parallel capacitor $C_1$ and fed through feedthrough insulator 232 to feedwire 126 in FIG. 1. Impedance matching transformer 230 may be enclosed in an electrically conductive outer shield 228 electrically connected to ground plane 130 to prevent radiation of input signal 118 from inside impedance matching transformer 230. FIG. 4 lists exemplary component values for inductor L, parallel capacitor $C_1$, and series capacitor $C_2$ for a twin-loaded 12.6-meter twin antenna having the structure shown in FIG. 1.

Figure 5:
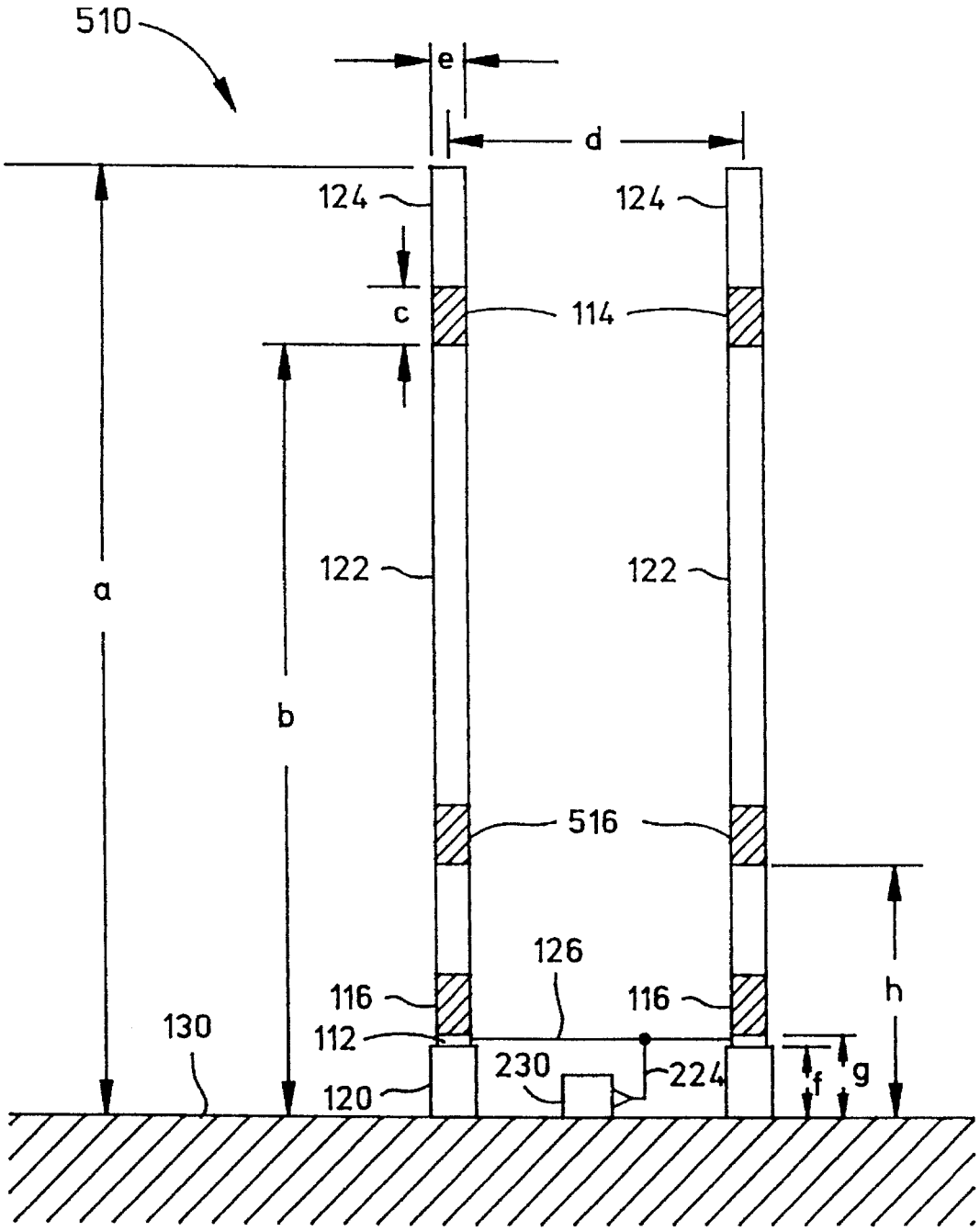
FIG. 5 depicts an alternative structure embodying a twin antenna of the present invention having an additional loading element.

Another structure embodying the twin antenna of the present 24 invention is depicted in FIG. 5. A twin whip antenna 510 is similar to that of FIG. 1, except that an additional center loading element 516 is located in center section 122 preferably about 0.5 percent of the base wavelength from lower loading element 116. Center loading element 516 is added to further raise the power handling capability of twin whip antenna 510. FIG. 6 lists exemplary dimensions and component values for a triple-loaded 11.6-meter twin antenna having the structure shown FIG. 5.

The power handling capability of the twin antenna of the present invention may be increased by paralleling resistors of higher value to distribute power dissipation. Also, more loading elements may be added to further distribute power dissipation.

The advantages of lower power dissipation over existing full-band low VSWR HF single whip antenna designs do not result from simply doubling the number of radiating loading elements of an optimum single whip design, as can be seen by comparing the values for the examples with single whip antennas. The present invention takes advantage of the observation that the lower loading element component values primarily affect the low end of the effective frequency band while the upper loading element component values primarily affect the high end. In addition, the closer the lower loading element is located toward the feedwire, the lower the VSWR generally becomes.

Twin-whip antennas may theoretically be designed for frequencies through UHF. Also, the antenna sections may utilize distributed loading rather than discrete components by making the antenna sections of composite materials formulated to have the required electrical properties of resistance, capacitance, and inductance.

Figure 7:
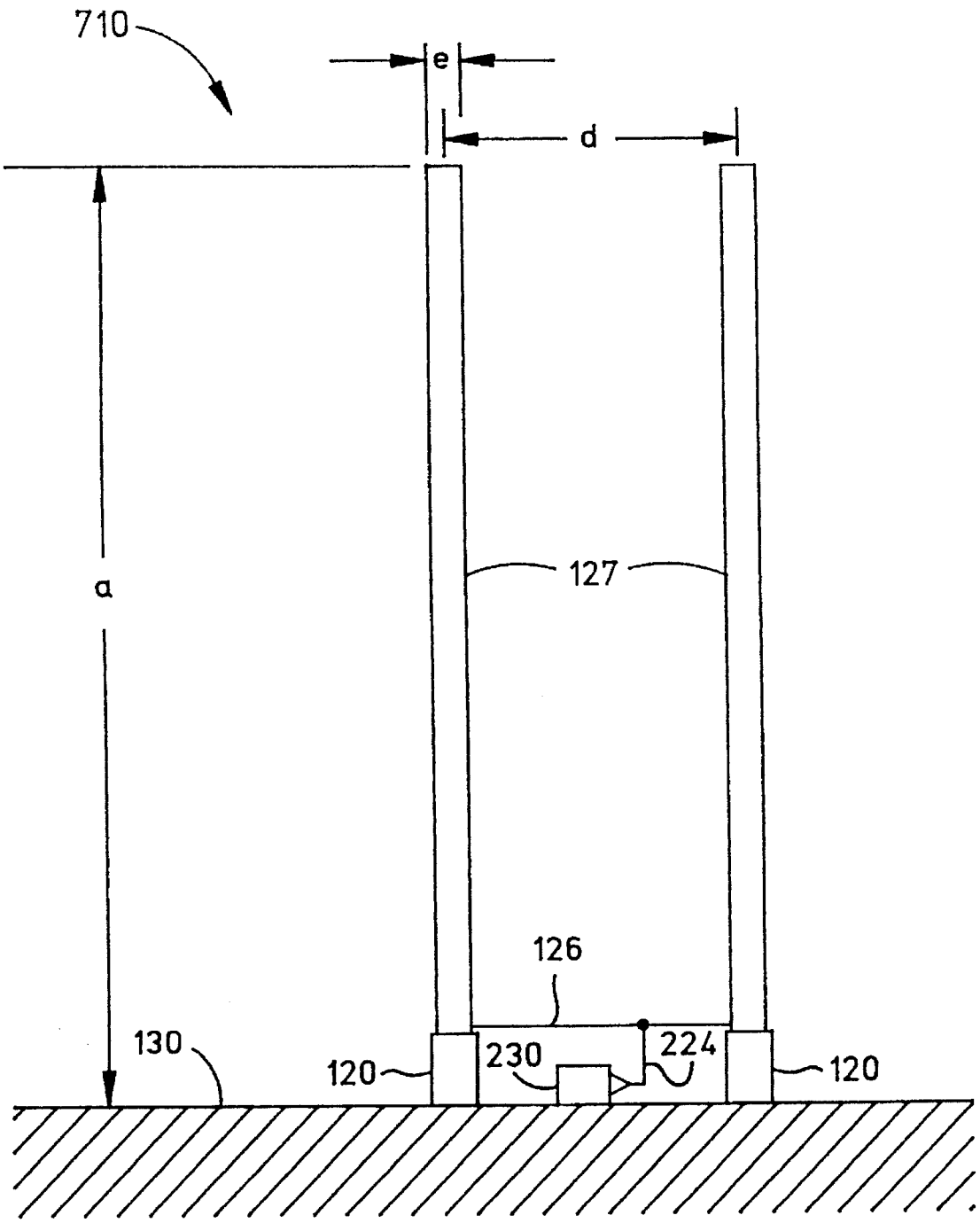
FIG. 7 depicts an alternative structure embodying a twin whip antenna of the present invention which incorporates the loading elements into the composition of the radiating elements.

FIG. 7 depicts an example of a structure embodying a twin whip antenna 710 of the present invention which incorporates the loading elements into the composition of radiating elements 127. Each radiating element 127 has a distributed resistance, capacitance, and inductance, and may be formed into an appropriate shape, for example, a solid or hollow cylinder having an outer diameter 'e' or an upward taper.

Still referring to FIG. 7, twin whip antenna 110 has an overall length 'a' about equal to a base wavelength corresponding to the lowest frequency of a feed signal 224. Radiating elements 127 may be fixed to electrical insulators 120 having a height appropriate to the voltage breakdown strength of the insulating material and the voltage magnitude of feed signal 224. Electrical insulators 120 are preferably fixed to a horizontal ground plane 130 and spaced apart a distance 'd' of about 25 percent of the base wavelength. A feedwire 126 conducts feed signal 224 from impedance transformer 230 to radiating elements 127.

Test results from 1/10 scale models made for two 11.6-meter twin whip antennas having two and three loading sections per whip are described in Technical Document 2597, Naval Command, Control and Ocean Surveillance Center, RDT&E Division, San Diego, Calif., January 1994, incorporated herein by reference.

Other modifications, variations, and applications of the present invention may be made in accordance with the above teachings other than as specifically described to practice the invention within the scope of the following claims.

I claim:

1. A high-power broadband antenna comprising:

at least two vertical antenna sections each comprising a plurality of substantially collinear electrically conductive radiating elements operably coupled to a broadband input signal for enhancing antenna efficiency of said high-power broadband antenna for said broadband input signal, wherein each said antenna section is fixed to an electrical insulator mounted on a horizontal ground plane; and at least two loading elements electrically coupled to said radiating elements; wherein each of said loading elements comprises a parallel combination of a resistor, an inductor, and a capacitor formed into each of said antenna sections and operably coupled to said radiating elements for effecting said antenna efficiency of said high-power broadband antenna, wherein:

said antenna sections are spaced apart by approximately 2 percent or less of a base wavelength;

each of said antenna sections comprises a lower section, a center section, and an upper section;

said lower section has a length sufficient for making an electrical connection to an impedance matching transformer;

said center section has a length of approximately 6 percent of said base wavelength; and said upper section has a length of approximately 1 percent of said base wavelength.

2. A high-power broadband antenna comprising:

at least two vertical antenna sections each comprising a plurality of substantially collinear electrically conductive radiating elements operably coupled to a broadband input signal for enhancing antenna efficiency of said high-power broadband antenna for said broadband input signal, wherein each said antenna section is fixed to an electrical insulator mounted on a horizontal ground plane;

at least two loading elements electrically coupled to said radiating elements; wherein each of said loading elements comprises a parallel combination of a resistor, an inductor, and a capacitor formed into each of said antenna sections and operably coupled to said radiating elements for effecting said antenna efficiency of said high-power broadband antenna, wherein:

said antenna sections are spaced apart by approximately 2 percent of a base wavelength;

each of said antenna sections comprises a lower section, a center section, an upper section, and a top section;

said lower section has a length sufficient for making an electrical connection to an impedance matching transformer;

said center section has a length of approximately 0.5 percent of said base wavelength;

said upper section has a length of approximately 5 percent of said base wavelength; and said top section has a length of approximately 1 percent of said base wavelength.

3. A high-power broadband antenna comprising:

at least two vertical antenna sections each comprising a plurality of substantially collinear electrically conductive radiating elements operably coupled to a broadband input signal for enhancing antenna efficiency of said high-power broadband antenna for said broadband input signal, wherein each said antenna section is fixed to an electrical insulator mounted on a horizontal ground plane;

at least two loading elements electrically coupled to said radiating elements; wherein each of said loading elements comprises a parallel combination of a resistor, an inductor, and a capacitor formed into each of said antenna sections and operably coupled to said radiating elements for effecting said antenna efficiency of said high-power broadband antenna;

an impedance transformer comprising:

a coaxial feed cable for electrically coupling an input signal to said high-power broadband antenna;

radio frequency transformer electrically coupled to said coaxial feed cable;

series capacitor electrically coupled to said radio frequency transformer;

a parallel capacitor electrically coupled between said series capacitor and said ground plane;

a parallel inductor electrically coupled between said series capacitor and said ground plane; and feedwire electrically coupling each of said antenna sections to a tap point between said series capacitor and said parallel capacitor.

4. The high-power broadband antenna of claim 3, further comprising a radio frequency source for providing said broadband input signal to said impedance transformer.

5. A high-power broadband antenna comprising:

at least two vertical antenna sections each comprising at least two electrically conductive substantially collinear radiating elements operably coupled to a broadband input signal, wherein:

each of said antenna sections is fixed to an electrical insulator mounted on a horizontal ground plane, each said radiating element comprises a combination of length, resistance, capacitance, and inductance for enhancing antenna efficiency of said high-power broadband antenna;

an impedance transformer comprising:

coaxial feed cable for electrically coupling said broadband input signal to said high-power broadband antenna;

a radio frequency transformer electrically coupled to said coaxial feed cable;

a series capacitor electrically coupled to said radio frequency transformer;

a parallel capacitor electrically coupled between said series capacitor and said ground plane;

a parallel inductor electrically coupled between said series capacitor and said ground plane; and a feedwire electrically coupling each of said antenna sections to a tap point between said series capacitor and said parallel capacitor.

6. The high-power broadband antenna of claim 5, wherein:

said antenna sections are spaced apart by approximately 2 percent of a base wavelength; and each said radiating element has an length approximately equal to said base wavelength.

7. The high-power broadband antenna of claim 5, further comprising a radio frequency source for providing said broadband input signal to said impedance transformer.

* * * * *